US006096977A

United States Patent [19]

Beggs et al.

[11] Patent Number: 6,096,977

[45] **Date of Patent: *Aug. 1, 2000**

[54] HIGH SPEED TRANSMISSION PATCH CORD CABLE

[75] Inventors: Richard D. Beggs, Buford, Ga.; Daryle P. Donner, Council Bluffs, Iowa; David R. Hawkins, Sugar Hill, Ga.; Stephen T. Zerbs, Gretna, Nebr.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/146,806

[22] Filed: Sep. 4, 1998

[51] Int. Cl.[7] ..... H01B 7/28

[52] U.S. Cl. ..... 174/113 R; 174/121 A

[58] Field of Search ..... 174/113 R, 121 A, 174/36, 27, 34, 128.1

[56] References Cited

U.S. PATENT DOCUMENTS

| | | | |
|---|---|---|---|
| Re. 27,830 | 12/1973 | Schoerner | 174/128.1 |
| 5,424,491 | 6/1995 | Walling et al. | 174/113 R |
| 5,493,071 | 2/1996 | Newmoyer | 174/113 R |
| 5,600,097 | 2/1997 | Bleich et al. | 174/113 R X |
| 5,619,016 | 4/1997 | Newmoyer | 174/113 R |
| 5,689,090 | 11/1997 | Bleich et al. | 174/121 A |
| 5,763,823 | 6/1998 | Siekierka et al. | 174/27 |
| 5,767,441 | 6/1998 | Brorein et al. | 174/27 |
| 5,814,768 | 9/1998 | Wessels et al. | 174/113 R X |

*Primary Examiner*—Kristine Kincaid
*Assistant Examiner*—Chau N. Nguyen

[57] ABSTRACT

An electrical cable is disclosed in which at least two pairs of insulated conductors are bound by a substantially circular jacket. The conductors in one of the pairs are twisted or rotated about one another in a spiral pattern at a frequency corresponding to a first twist lay or length. The conductors in a second pair are also twisted about one another at a frequency corresponding to a second twist lay. Finally, the two pairs of conductors are stranded about one another at a frequency corresponding to a strand lay. The substantially circular jacket resists the tendency to jam cable processing machines (e.g., a connectorization machine) when being dispensed from a pay-off reel, which is a common problem in prior art patch cord designs. As a result, the cable reduces manufacturing costs. In addition, the cable provides improved electrical performance, as measured by several performance standards, over prior art cable designs.

5 Claims, 4 Drawing Sheets

HIGH SPEED TRANSMISSION PATCH CORD CABLE

BACKGROUND OF THE INVENTION

The present invention relates generally to filamental articles, such as insulated wire, stranded cable, or the like, that are stored and dispensed from a coil configuration, and, more particularly, to a novel design for such filamental articles that facilitates their dispensation from a storage device.

In the manufacture of many elongated filament type products, such as electrical wire or cable, it is common practice to wind the filament in a coil form about a reel that facilitates shipping of the wound filament and subsequent storing, as well as providing a mechanism by which the filament can be dispensed during manufacture to produce a specific product or by a retailer to fulfill purchase requests for specific lengths of the filament.

One example of a filamental type product stored in a coil configuration is electrical patch cord cable that is customarily stored in coils wound about 30" reels known as pay-off reels. The patch cord cable is frequently configured as two pairs of insulated conductors surrounded by an outer jacket. The cable is dispensed from the payoff reel and fed into a connectorization machine that cuts the cable into sections and applies connector plugs to the section ends. The existing patch cord cable is generally oval shaped with the two conductor pairs positioned side by side when viewed along a cross section of the cable. Unfortunately, this oval shaped design causes the cable to have a tendency to rotate, thus accumulating jacket rotations between the pay-off reel and the connectorization machine. As a result, the connectorization process must be stopped and the rotated cable portion must be cut out and removed. Once the rotated portion of cable has been extracted, the cable is re-threaded into the connectorization machine and the process is resumed. This exercise of clearing cable rotations occurs many times during the processing of a single pay-off reel, which carries thousands of feet of cable.

Accordingly, what is sought is a cable that exhibits an improved pay-off behavior by resisting the tendency to twist or rotate as the cable is dispensed from a pay-off reel. It is further desirable that the cable provide electrical characteristics that are equal to or better than those provided by the oval shaped cables used heretofore.

SUMMARY OF THE INVENTION

Certain advantages and novel features of the invention will be set forth in the description that follows and will become apparent to those skilled in the art upon examination of the following or may be learned with the practice of the invention.

To achieve the advantages and novel features, the present invention is generally directed to an electrical cable in which at least two pairs of insulated conductors are bound by a substantially circular jacket. The insulated conductors in one of the pairs are twisted or rotated about one another in a spiral pattern at a frequency corresponding to a first twist lay or length. The insulated conductors in a second pair are also twisted about one another at a frequency corresponding to a second twist lay. Finally, the two pairs of insulated conductors are twisted about one another at a frequency corresponding to a strand lay.

In accordance with one aspect of the invention, the first twist lay and second twist lay are different from one another.

In accordance with another aspect of the invention, the conductors are made from wire strands that are rotated about one another along the length of the conductor.

In accordance with yet another aspect of the invention, the stranded wire is rotated in the opposite direction to the twist direction of the insulated conductors making up a single pair.

In accordance with still another aspect of the invention, the stranded wire is rotated in the same direction as the twist direction of the insulated conductors making up a single pair.

The electrical cable according to the present invention has many advantages, a few of which are set forth hereafter as examples.

One advantage of the present invention is that the cable uses a substantially circular jacket to confine the conductor pairs that naturally resists the tendency to rotate under dispensation from a pay-off reel or similar storage device.

Another advantage of the present invention is that improved electrical transmission performance is achieved as a result of the twist or rotation applied to the stranded wire, to the insulated conductors comprising the cable core, and to the pairs.

BRIEF DESCRIPTION OF THE SEVERAL VIEWS OF THE DRAWINGS

Other features of the present invention will be more readily understood from the following detailed description of specific embodiments thereof when read in conjunction with the accompanying drawings, in which.

DETAILED DESCRIPTION OF THE PREFERRED EMBODIMENT

Figure 1:
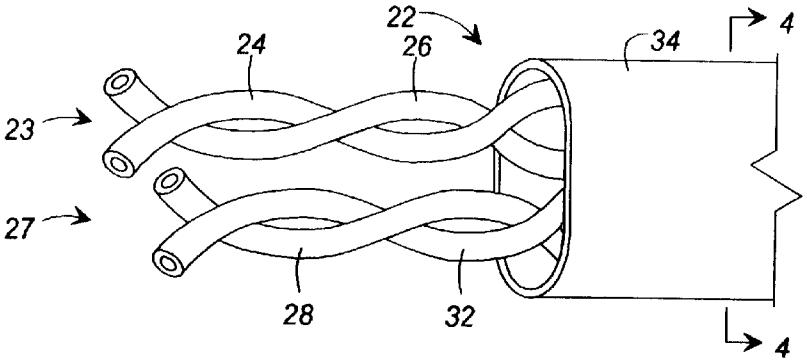
FIG. 1 (PRIOR ART)
FIG. 1 is a perspective view of a prior art patch cord or jumper cable having a generally oval shaped outer jacket and carrying two insulated conductor pairs.

While the invention is susceptible to various modifications and alternative forms, a specific embodiment thereof is shown by way of example in the drawings and will herein be described in detail. It should be understood, however, that there is no intent to limit the invention to the particular form disclosed, but on the contrary, the invention is to cover all modifications, equivalents, and alternatives falling within the spirit and scope of the invention as defined by the claims.

The present invention will be described hereafter by way of example with respect to a patch cord or jumper type cable. The skilled artisan will nevertheless appreciate that the teachings disclosed herein can be applied to other types of cables that are embodied in an oval or ribbon style cross-sectional architecture and have a tendency to twist or rotate when handled or processed.

Figure 2:
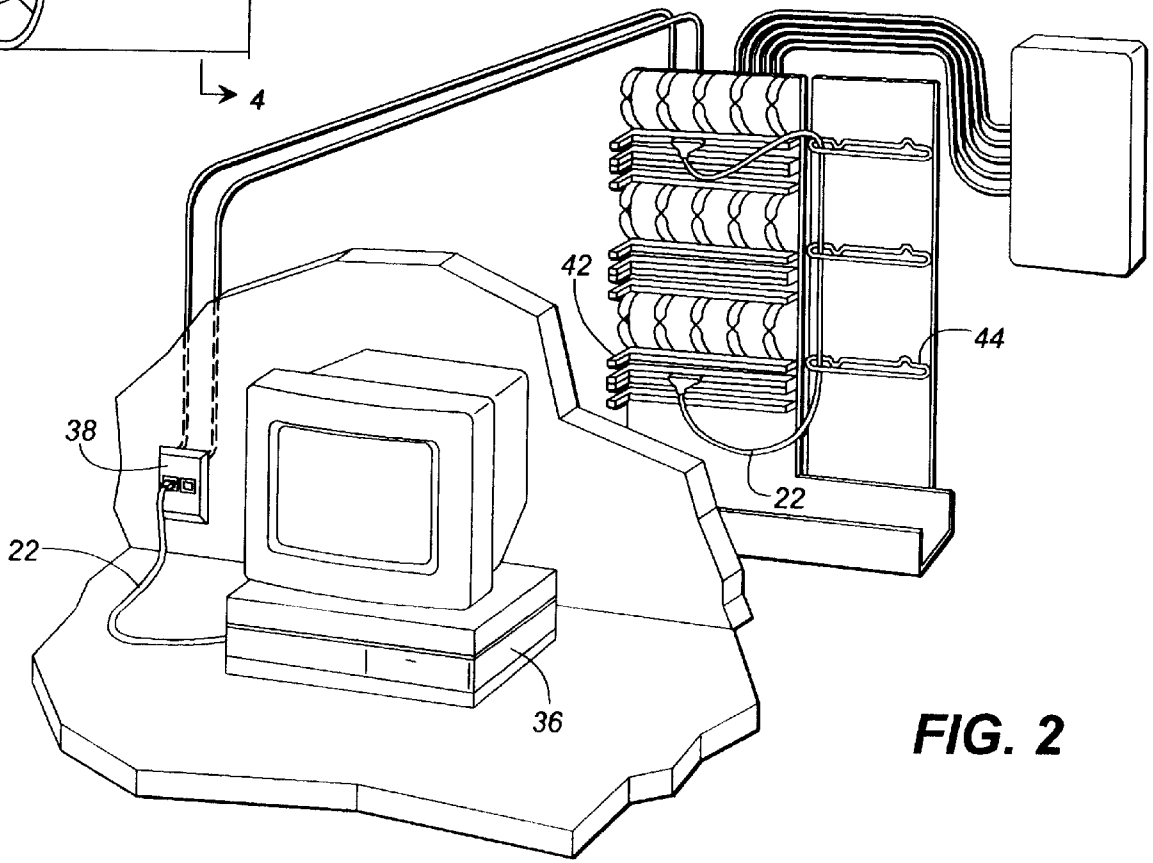
FIGS. 2 and 3 illustrate typical applications for patch cords or jumper cables made from the prior art cable of FIG. 1 or from the cable according to the present invention.
Figure 3:
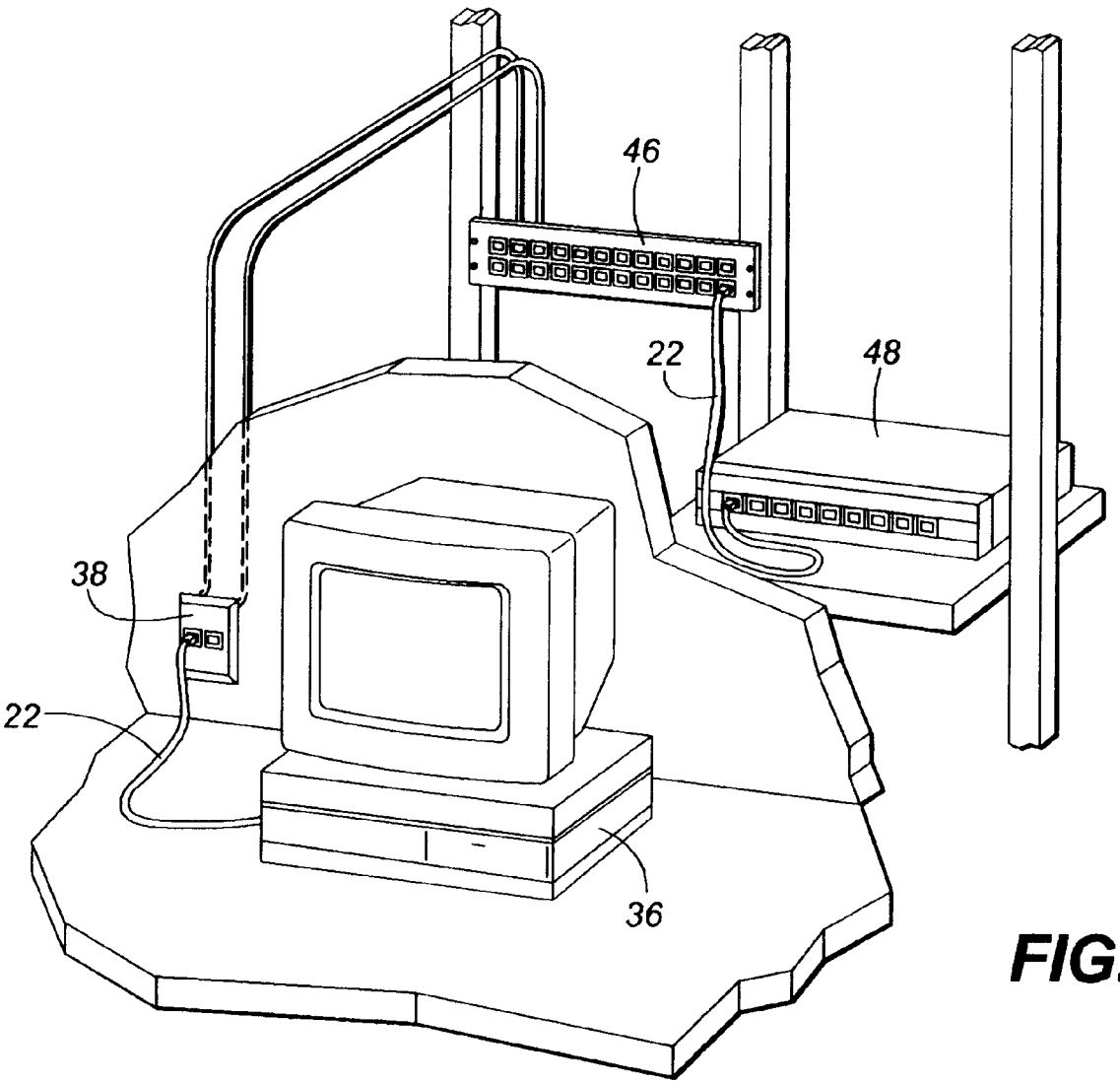

With reference to FIG. 1, a prior art jumper or patch cord cable 22 comprises a first pair 23 of insulated conductors 24 and 26 and a second pair 27 of insulated conductors 28 and 32 disposed side by side and surrounded by an outer, oval shaped jacket 34. As shown in FIG. 2, patch cord cable 22 is generally used to connect customer premise equipment (CPE) 36 to a wall jack 38 or in a telecommunications closet to make cross connections between jacks on a first panel 42 and a second panel 44. FIG. 3 shows still another application for patch cord cable 22 in which cable 22 is used to make a connection between a panel 46 in a telecommunications closet and a piece of communications equipment 48, such as a multiplexer.

Figure 4A:
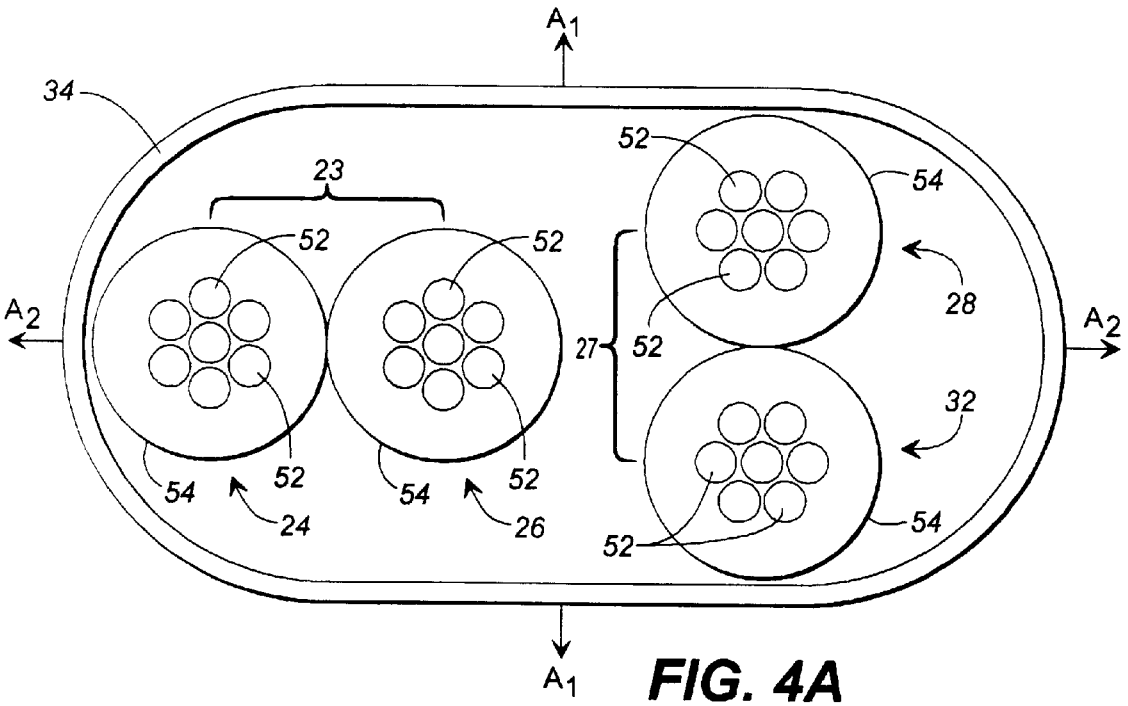
FIG. 4A (PRIOR ART)
FIG. 4A provides a cross sectional view of the prior art cable of FIG. 1.

FIG. 4A depicts a cross-sectional view of cable 22 taken along lines 4—4 of FIG. 1. From this view, conductors 24, 26, 28, and 32 are each shown to comprise stranded wire 52 surrounded by insulation 54. Because of the geometry of outer jacket 34, conductor pairs 23 and 27 are segregated from one another on opposite sides of jacket 34. Thus, while the individual conductors in pairs 23 and 27 are twisted about each other along the length of cable 22, the pairs 23, 27 themselves do not engage each other in a twist or spiral pattern.

Figure 4B:
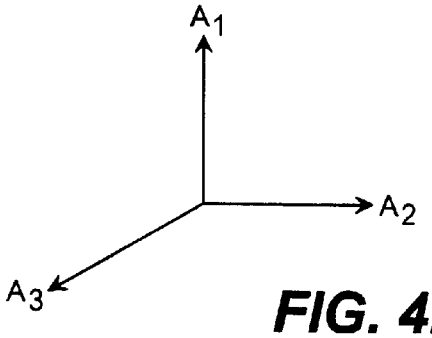
FIG. 4B illustrates the relationship between the various axes of FIG. 4A.

Because of the oval shaped geometry of jacket 34, cable 22 possesses two distinct axes: $A_1$, which is defined along the shorter width of the oval defined by jacket 34, and $A_2$, which is defined along the longer width of the oval defined by jacket 34. FIG. 4B provides a three-dimensional perspective of axes $A_1$ and $A_2$ with a third axis $A_3$ shown to be perpendicular to $A_1$ and $A_2$, which corresponds to the axis defined by the length of cable 22. The oval shape of cable 22 can be problematic, as discussed hereinbefore, particularly when cable 22 is dispensed from a pay-off reel for reception in, for example, a connectorization machine. The connectorization machine accepts cable 22 from a pay-off reel and cuts cable 22 into segments. Connectors or plugs are then attached to the segment ends to form the patch cord or jumper cables. Due to the natural leverage that can be applied to cable 22 because of the oval shape, cable 22 tends to rotate about axis $A_3$ with axis $A_2$ tending to move towards axis $A_1$. As a result, cable 22 tends to accumulate rotations between the pay-off reel and the connectorization machine. That requires the machine to be stopped and the rotated portion of cable removed. The machine must then be re-threaded with the cable 22 and the process restarted. During processing of an entire pay-off reel of cable (approximately 16,000 feet based on the size of some manufacturers reels), the process must be stopped to remove cable rotations many times, which adds to the manufacturing expense of patch cord and jumper cables.

Figure 5:
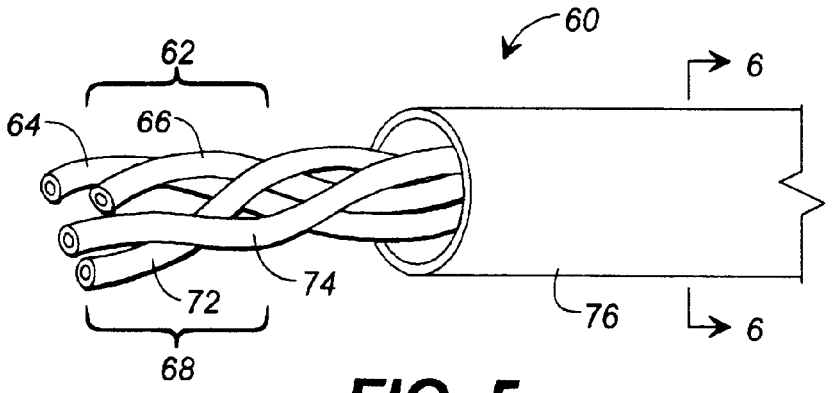
FIG. 5 is a perspective view of a patch cord or jumper cable carrying two conductor pairs in accordance with the principles of the present invention.

A patch cord cable 60 embodying the principles of the present invention is shown in FIG. 5. Like cable 22, patch cord cable 60 includes a first pair 62 of insulated conductors 64 and 66 and a second pair 68 of insulated conductors 72 and 74. The individual insulated conductors 64, 66, 72, and 74 in each insulated conductor pair 62 and 68 are twisted around each other in a spiral pattern similar to the insulated conductor pairs 23 and 27 of the prior art cable 22 of FIG. 1. In contrast to the prior art cable 22, however, the insulated conductor pairs 62 and 68 in cable 60 are also rotated or stranded around each other in a spiral pattern as depicted in FIG. 5, which is now possible through the use of a substantially circular outer jacket 76, typically made from polymers, such as polyolefins, polyvinyls, or fluoropolymers. The electrical transmission benefits of such an arrangement will be discussed in more detail hereafter.

Figure 6:
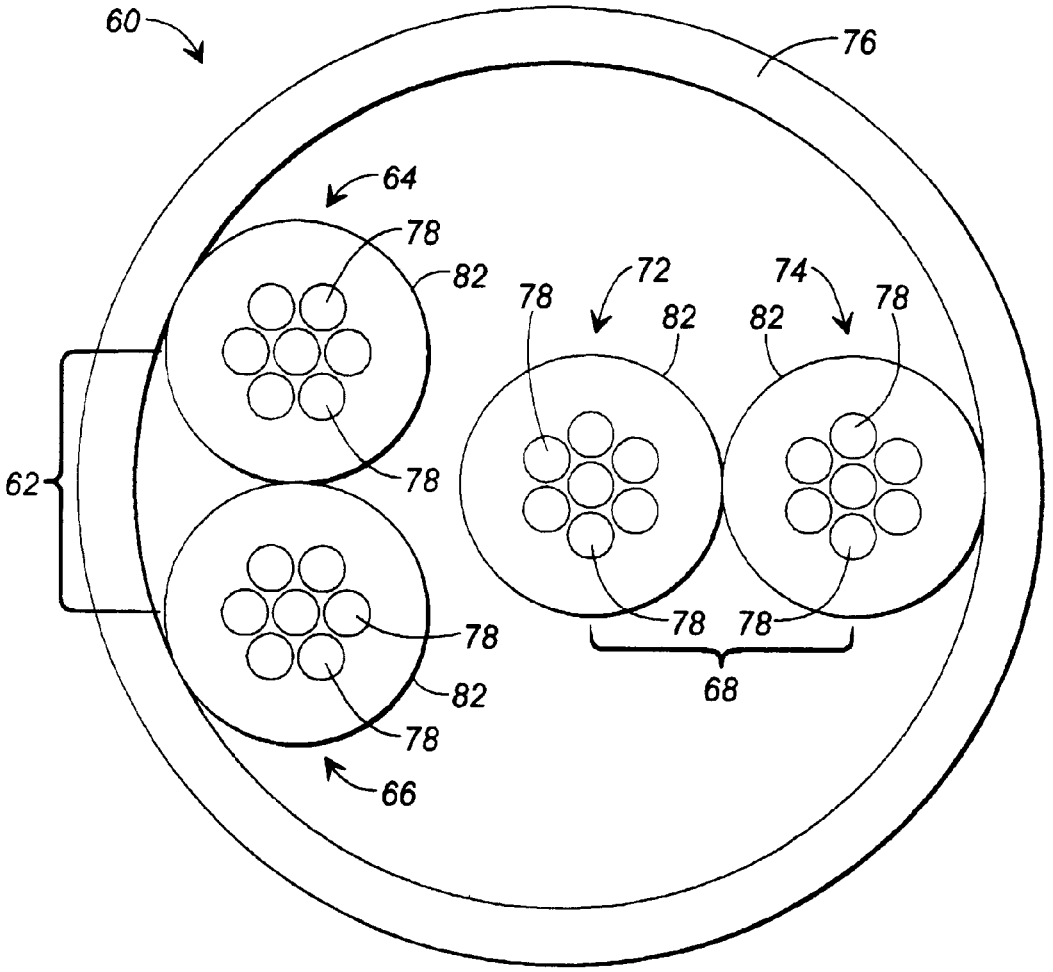
FIG. 6 is a cross sectional view of the patch cord or jumper cable of FIG. 5.

FIG. 6 depicts a cross sectional view of cable 60 taken along lines 6—6 of FIG. 5. From this view, conductors 64, 66, 72, and 74 are each shown to comprise a stranded wire core 78 surrounded by insulation 82. Stranded wire 78 is typically used in jumper or patch cord cables because of the flexibility and durability it provides over single filament insulated conductors. Because of the substantially circular geometry of outer jacket 76, conductor pairs 62 and 68 are twisted with one another along the length of cable 60. In other words, insulated conductor pairs 62 and 68 change position periodically throughout the length of cable 60 unlike prior art cable 22 in which each insulated conductor pair 23, 27 is relegated to a single side of the cable and is not permitted to shift from one side of cable 22 to the other side as shown in FIG. 4A.

It should be appreciated that because of the circular geometry of jacket 76, all cross-sectional axes of jacket 76 are equivalent, thus there is no tendency for cable 60 to exhibit any cross-sectional jacket geometry other than a substantially circular geometry throughout its defined length. As a result, cable 60 is particularly useful for application as a patch cord or jumper cable because it can readily be dispensed from a pay-off reel without causing a jam due to rotation as it is being fed into a connectorization machine. The use of cable 60 to manufacture patch cord and jumper cables produces significant savings in manufacturing cost because the instances of cable jamming that require the process to be shut down are virtually eliminated.

In addition to the improved physical behavior of cable 60 over prior art cable 22, cable 60 also provides improved electrical characteristics over the prior art cable. Several parameters are used to measure the electrical performance of a transmission cable. Three examples of these parameters include structural return loss (SRL), crosstalk, and capacitance unbalance.

Structural return loss is a measure of the variation of impedance within the cable from one section to the next. This variation causes a form of noise at the receiver. SRL is measured in units of dB with the SRL being greater as the consistency of the impedance of the cable increases. The parameters that affect cable impedance uniformity include the average separation or distance between two conductors, twist uniformity of the conductors, and cross-sectional uniformity of the conductors.

Crosstalk is defined as the cross coupling of electromagnetic energy between adjacent conductor pairs in the same cable bundle or binder. Crosstalk can be categorized in one of two forms: Near End Crosstalk, commonly referred to as NEXT, is the most significant because it measures the effects of crosstalk on an attenuated receiver signal from a high energy transmitted signal on an adjacent conductor. The other form is Far End Crosstalk or FEXT. FEXT measures the effects of crosstalk from a far end signal, which is typically less of an issue because the far end interfering signal is attenuated as it traverses the loop.

Capacitance unbalance is a measure of the difference in capacitance between one conductor in a conductor pair with respect to all other conductors in a cable and the second conductor in the conductor pair with respect to all other conductors the cable.

Referring now to FIGS. 5 and 6, cable 60 according to the present invention uses various techniques to improve electrical performance. First, the insulated conductors 64, 66, 72, and 74 comprising each pair 62 and 68 are twisted within the pair. It has been found that electrical performance can be improved by varying the twist lay (i.e., the length of a single twist) between insulated conductor pairs. Accordingly, the twist lay for insulated conductors 64 and 66 preferably ranges from approximately 0.5" to approximately 0.75" while the twist lay for insulated conductors 72 and 74 preferably ranges from approximately 0.35" to approximately 0.5". In addition to applying a twist to the individual insulated conductors in a pair, it is also advantageous to engage the insulated conductor pairs 62 and 68 in a strand arrangement. Preferably the strand lay (i.e., length of a single strand) for conductor pairs 62 and 68 ranges from approximately 4.2" to approximately 5". In the preferred embodiment of cable 60, the twist lay for insulated conductors 64 and 66 is 0.67", the twist lay for insulated conductors 72 and 74 is 0.44", and the strand lay for insulated conductor pairs 62 and 68 is 4.8".

It should be understood that the present invention is also directed to cables designed using any common multiple of the twist/strand lay ranges set forth in the foregoing. That is, while a particular set of quantified criteria for establishing a preferred twist/strand lay scheme has been disclosed, it is further recognized that significant operational performance enhancement can be achieved through a cable using a twist/strand lay scheme in which the twist lengths and strand lengths are common multiples or factors of any of the values within the ranges disclosed as the preferred embodiment.

Yet another technique for improving electrical performance is to rotate stranded wire 78 and insulation 82 comprising the individual insulated conductors 64, 66, 72, and 74. Rotating stranded wire 78 and insulation 82 produces a cancellation effect that compensates for variations in the diameter of insulation 82 surrounding the wire. The rotation also negates the effect of off-centeredness of stranded wire 78 in insulation 82, which tends to improve SRL performance. Stranded wire 78 and insulation 82 can be rotated either in the same or in the opposite direction as the twist applied to the insulated conductors in a conductor pair. By rotating stranded wire 78 and insulation 82 in the opposite direction as the twist applied to the pair, however, transmission loss in the cable is reduced.

Through use of the aforementioned techniques, cable 60 according to the present invention improves SRL performance by approximately 2 dB over the prior art cable of FIGS. 1 and 4A. One specification for SRL performance is given by Equation 1 set forth below:

$$\text{SRL} > 25\ (\text{dB})\ 0.772\ \text{MHz} \leqq \text{frequency} \leqq 20\ \text{MHz}$$

$$\text{SRL} > 25 - 10 \log(\text{frequency}/20\ \text{MHz})\ (\text{dB})\ 20\ \text{MHz} < \text{frequency} \leqq 300\ \text{MHz} \qquad \text{EQ. 1}$$

Cable 60, according to the present invention, exceeds this specification for SRL performance. Moreover, the average capacitance unbalance has improved to a value of 6.67 pF/100 meters for cable 60 from 15.67 pF/100 meters for prior art cable 22. Crosstalk between the insulated conductor pairs is minimized as a result of the twisting/stranding algorithm applied to the insulated conductor pairs and the combination of the pairs. More specifically, one specification for NEXT coupling loss over the frequency range from 0.772 MHz to 300 MHz is given by Equation 2 set forth below:

$$\text{NEXT coupling loss} > 74 - 15 \log(\text{frequency}/0.772)\ (\text{dB}) \qquad \text{EQ. 2}$$

As a result of the twisting/stranding algorithm used in cable 60 in accordance with the present invention, NEXT coupling loss in cable 60 exceeds this specification.

It should be appreciated that the improved electrical performance exhibited by cable 60 can be attributed to the unique twist/strand lay scheme disclosed herein. In effect, the electrical performance of cable 60 is precisely tuned through judicious selection of twist and strand lays made possible through use of the substantially circular jacket 76.

The principles of the present invention have been illustrated herein as they are applied to a transmission patch cord or jumper cable. From the foregoing it can readily be seen that the transmission cable according to the present invention exhibits an improved structural behavior in that it resists the tendency to jam cable processing machines (e.g., a connectorization machine) when being dispensed from a pay-off reel, which is a common problem in prior art patch cord designs. As a result, the present cable reduces manufacturing costs. In addition, the cable provides improved electrical performance, as measured by several performance standards, over prior art patch cord designs.

In concluding the detailed description, it should be noted that it will be obvious to those skilled in the art that many variations and modifications can be made to the preferred embodiment without substantially departing from the principles of the present invention. For example, the present invention has been disclosed herein as a patch cord comprising two pairs of insulated conductors. The principles of the invention can also be applied to cables carrying larger numbers of conductor pairs with equal success. All such variations and modifications are intended to be included herein within the scope of the present invention, as set forth in the following claims.

We claim:

1. A patch cord electrical cable resistant to rotation during pay-off from a storage reel, said cable consisting of:

first and second pairs of elongated insulated conductors, wherein said conductors are made of stranded wire, the conductors in each pair being twisted together along their lengths and the first and second twisted pairs being twisted together along their lengths in a manner such that they can be contained in a substantially circular jacket;

said substantially circular jacket surrounding and containing said pairs;

said first pair of conductors having a first twist lay of approximately 0.67 inches;

said second pair of conductors having a second twist lay of approximately 0.44 inches; and said first and second pairs being twisted together with a strand lay such that said pairs periodically change position within said circular jacket, said strand lay being within the range of approximately 4.2 to 5.0 inches.

2. The electrical cable of claim 1, wherein said strand lay is approximately 4.8 inches.

3. The electrical cable of claim 1, wherein said insulated stranded wire is rotated along a length of said insulated conductors.

4. The electrical cable of claim 3, wherein said insulated conductors in said first and second pairs are twisted within each said pair in a direction opposite to a rotation direction of said insulated stranded wire comprising said insulated conductors.

5. The electrical cable of claim 3, wherein said insulated conductors in said first and second pairs are twisted within each said pair in a same direction as said rotation direction of said insulated stranded wire comprising said insulated conductors.

* * * * *